US008281449B1

(12) United States Patent
Skaare

(10) Patent No.: US 8,281,449 B1
(45) Date of Patent: Oct. 9, 2012

(54) BRUSH WITH RETRACTABLE BRISTLES FOR EASY CLEANING

(76) Inventor: Kristian Louis Skaare, Plantation, FL (US)

( * ) Notice: Subject to any disclaimer, the term of this patent is extended or adjusted under 35 U.S.C. 154(b) by 0 days.

(21) Appl. No.: 13/050,245

(22) Filed: Mar. 17, 2011

(51) Int. Cl.
*A45D 1/04* (2006.01)

(52) U.S. Cl. ..... 15/169; 132/229

(58) Field of Classification Search ..... 15/169; 132/119
See application file for complete search history.

(56) References Cited

U.S. PATENT DOCUMENTS 4,327,753 A * 5/1982 Bertschi ..... 132/229
6,070,594 A 6/2000 Mears
6,631,831 B1 * 10/2003 Loiselle ..... 132/119
6,968,848 B2 11/2005 Grant et al.
7,739,769 B2 6/2010 DiPippo
2007/0199170 A1 * 8/2007 DiPippo ..... 15/169
* cited by examiner

*Primary Examiner* — Monica Carter
*Assistant Examiner* — Stephanie N Berry
(74) *Attorney, Agent, or Firm* — K&L Gates LLP

(57) ABSTRACT

A brush wherein the bristles are retractable to facilitate the cleaning thereof in an efficient and effective manner. The apparatus generally comprises bristles disposed on a bristle-holding tree, wherein the bristles extend through apertures of a housing in an extended position. There is also provided a stem base engaged with the bristle-holding tree such that the stem base imparts longitudinal force upon the bristle-holding tree, causing the bristle-holding tree to move longitudinally relative to the housing, causing the bristles to move from an extended position to a retracted position to permit easy cleaning of hair from the brush. The brush provides locking capabilities which allow a user to hold the brush in one hand and remove hair with the free hand.

15 Claims, 8 Drawing Sheets

BRUSH WITH RETRACTABLE BRISTLES FOR EASY CLEANING

BACKGROUND

As a grooming implement, the brush is highly effective in styling hair. Such styling can include straightening, smoothing, flattening and/or curling hair. Successfully styling hair, however, often results in the byproduct of hair accumulating on the bristles of the brush. Although it may be acceptable for some hair to accumulate on the brush, it often happens that a significant amount accumulates which can impair the styling of hair, be unsightly or fall off the brush. Accordingly, removal of accumulated hair from the bristles of the brush confers several benefits.

Efficient removal of unwanted hair from the brush, however, can be difficult and time-consuming. First, a good amount of tangled hair may have accumulated on and between the bristles. The accumulated hair may be caught between and among bristles, sometimes rigidly so. The hair may have become matted together. Some strands of hair may have become broken, further complicating hair removal.

In view of the foregoing, there is a need for a brush with enhanced advantages for efficient and effective cleaning of unwanted hair therefrom.

SUMMARY

In various embodiments of the present invention there is disclosed a brush whose bristles can be retracted to facilitate the cleaning thereof in an efficient and effective manner such that there is provided a bristle-holding tree having bristles, a housing disposed around the bristle-holding tree with bristles extending through apertures in the housing, a stem base engaged with the bristle-holding tree, and a locking mechanism engaged with the stem base wherein the locking mechanism is structured to move the bristle-holding tree and stem base as a unit longitudinally relative to the housing between an extended and retracted position of the bristles.

In various embodiments of the present invention there is disclosed a bristle-holding tree having bristles, a housing disposed around the bristle-holding tree with bristles extending through apertures in the housing, and a connector disposed within an upper handle and lower handle, the upper handle immediately adjacent to the lower handle, the connector engaged with the bristle-holding tree such that a stem base imparts rotational force upon the bristle-holding tree, causing the bristle-holding tree to move rotationally relative to the housing, thereby causing said bristles to move from an extended position to a retracted position. Additionally, the bristle-holding tree can be held or locked in place in a bristles-retracted position with a guide path terminating in a locking chamber.

In various embodiments of the present invention there is disclosed a bristle-holding tree having bristles, a housing disposed around the bristle-holding tree with bristles extending through apertures in the housing, and a connector disposed within a handle, the connector engaged with an arm for applying force, the handle containing an opening at its base through which the connector can slidably extend upon application of force to the arm, the connector engaged with the bristle-holding tree wherein the connector imparts longitudinal force upon the bristle-holding tree upon application of force by the arm, causing the bristle-holding tree to move longitudinally relative to the housing, causing the bristles to move from an extended position to a retracted position. Additionally, the bristle-holding tree can be held or locked in place in a bristles-retracted position with a guide path terminating in a locking chamber.

Further areas of applicability of the present invention will become apparent from the detailed description provided hereafter. It should be understood that the detailed description and specific examples, while indicating the preferred embodiment of the invention, are intended for purposes of illustration only and are not intended to limit the scope of the invention.

DRAWINGS

Embodiments of the present invention will become more fully understood from the detailed description and the accompanying drawings, which are not necessarily to scale, wherein.

DETAILED DESCRIPTION

Figure 1:
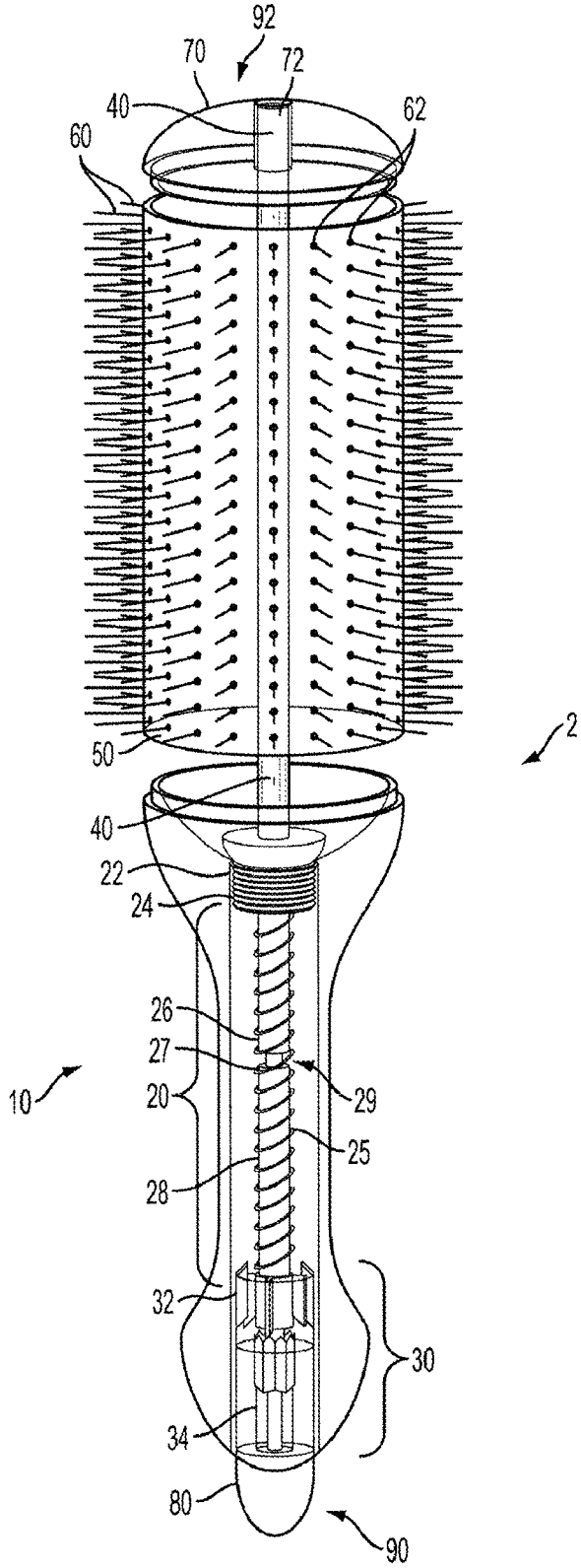
FIG. 1 depicts aspects of outer and inner assemblies of a brush in accordance with an embodiment.
Figure 2A:
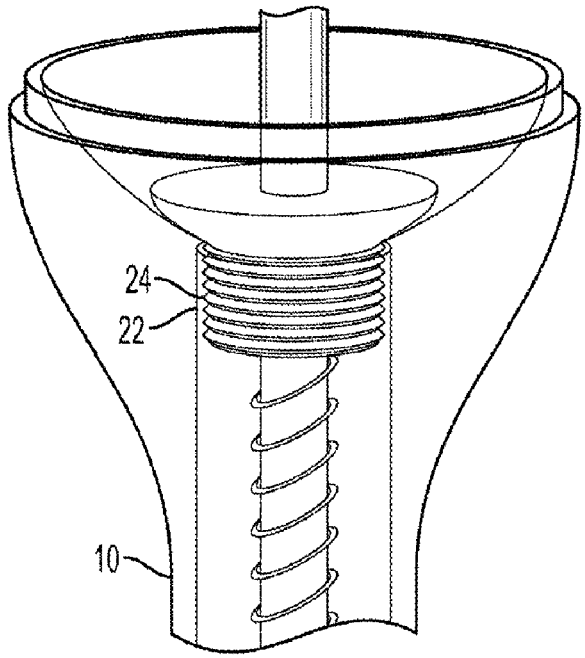
FIG. 2A depicts aspects of a handle of a brush in accordance with an embodiment.
Figure 2B:
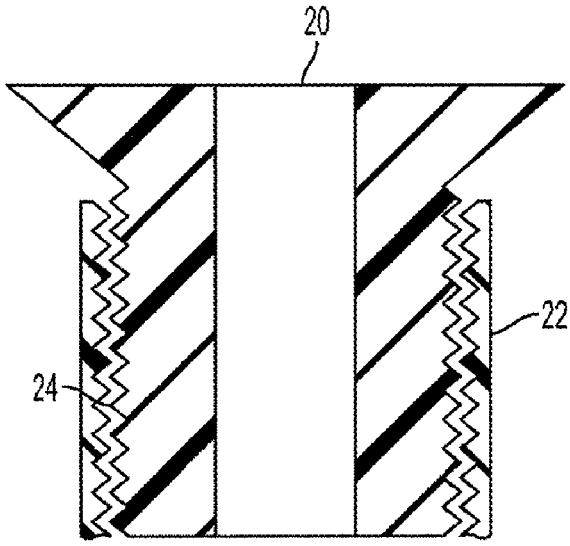
FIG. 2B depicts threads on a handle hat of a brush in accordance with an embodiment.

In various embodiments, a brush 2 has a handle 10, as in FIG. 1. Handle 10 functions to provide the user with a way of holding the brush. Also, handle 10 encloses stem base 20. Handle 10 has a center cavity 22 to enclose stem base 20. An upper portion of center cavity 22 may be threaded to allow for the handle hat 24 to be threadedly received therein. As can be appreciated, handle hat 24 can be secured in a fashion other than by being screwed in. FIG. 2A shows the upper area of handle 10 in more detail. Seen are handle hat 24 which may be threaded such that it can be secured to center cavity 22, thus residing in handle 10, which will create tension caused by the compressing of spring 25. FIG. 2B shows threads that surround handle hat 24.

Figure 3:
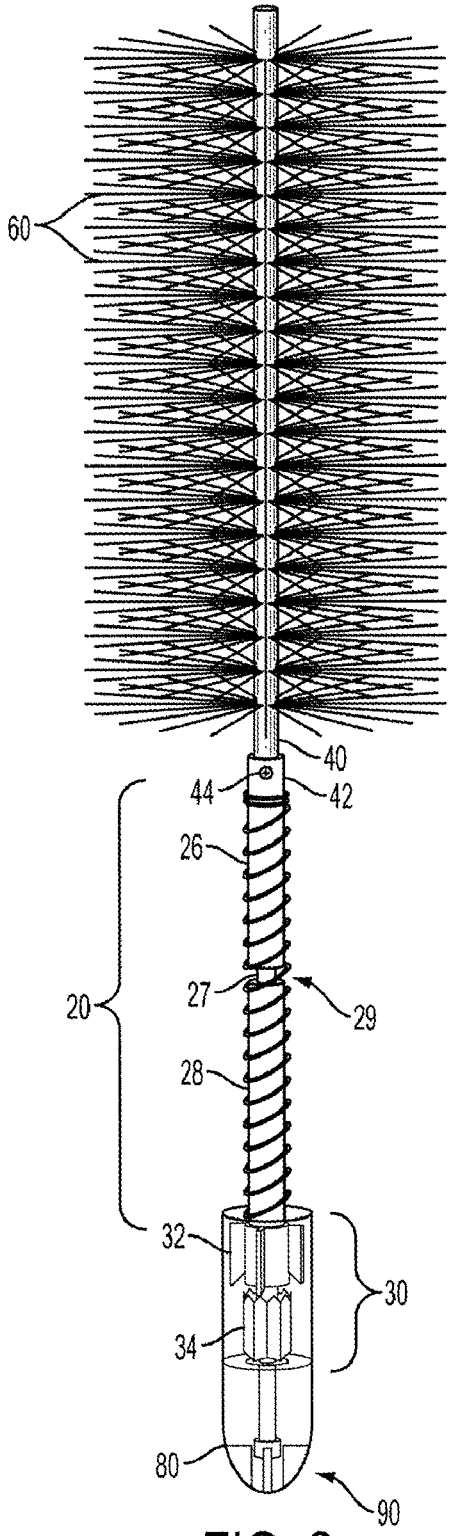
FIG. 3 shows an inner assembly of a brush in accordance with an embodiment.

Referring now to FIGS. 1 and 3, an inner assembly of a brush is shown. Stem base 20 is a structure engaged with bristle holding tree 40, locking mechanism 30 and clicker 80. When clicker 80 is depressed and then released, spring 25 exerts force such that stem base 20 moves bristle holding tree 40 in the direction of handle base 90. Bristle holding tree 40 moves relative to housing 50 such that bristles 60 extending out of apertures 62 can retract. In this way, the distance that bristles 60 extend relative to housing 50 decreases, facilitating easier removal of hair. Thus, bristles 60 effectively move from an extended position to a retracted position.

Bristle holding tree 40 may be a rod-shaped member with fibers secured to bristle holding tree 40 such that, in an embodiment, bristle holding tree 40 has bristles up to 360 degrees around the rod. In an embodiment, the bristle holding tree 40 may be made of metal, and the bristles of nylon. Bristles may also be of animal hair as well.

In various embodiments, housing 50 may be a tubular structure. Housing 50 encloses bristle holding tree 40. Bristles 60 are disposed through apertures 62 of the housing 50. The housing may be a plastic, metal or ceramic cylinder with staggered holes approximately ⅕ of an inch in diameter which may be about ½ inch apart from each other.

As shown in FIG. 1, top mold 70 is affixed to the top of the brush and has a cavity 72 into which the top of bristle holding tree 40 is inserted such that bristle holding tree 40 remains generally centered and bristles 60 in their proper apertures 62.

As discussed, stem base 20 is engaged with bristle holding tree 40. Stem base 20 is engaged with locking mechanism 30, which itself is engaged with clicker 80. Using a minimum of effort—such as one finger—the user depresses clicker 80. Clicker 80 in combination with locking mechanism 30 operates in a manner comparable to that of a ball point pen mechanism in which depressing a clicker member can alternate extension and retraction of a pen point.

Figure 4A:
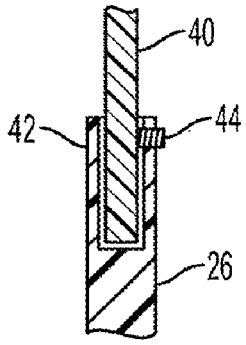
FIG. 4A shows detail relating to the junction of upper and lower portions of a brush in accordance with an embodiment.

Upper locking mechanism 32 comprises a covering that houses a cavity therethrough such that the bottommost part of the stem base 20 can be fitted securely inside upper locking mechanism 32. It will be appreciated that a locking mechanism other than a pen locking mechanism may be used. An example of a locking mechanism can be seen in greater detail in FIG. 4C. Upper locking mechanism 32 and lower locking mechanism 34 are disposed such that the grooves of lower locking mechanism 34 engage the upper locking mechanism 32. Because a projecting portion of upper locking mechanism 32 "rides" up and down the grooves of lower locking mechanism 34, a rotational force can be created when clicker 80 is activated.

Figure 4B:
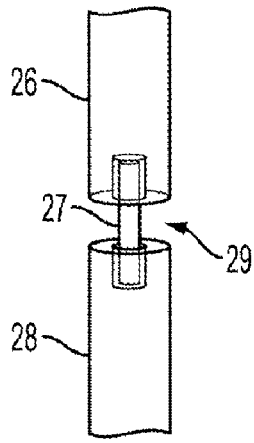
FIG. 4B shows detail relating to a pivot point at the junction of upper and lower stem bases of an assembly of a brush in accordance with an embodiment.
Figure 4C:
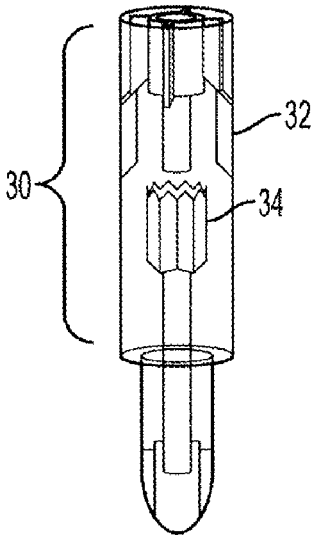
FIG. 4C shows detail relating to a locking mechanism of a brush in accordance with an embodiment.

Stem base 20 may be a structure that comprises two sections 26, 28. These may be considered the upper stem base 26 and lower stem base 28. As seen in FIG. 4B, upper stem base 26 and lower stem base 28 are joined by rod 27. This enables upper stem base 26 and lower stem base 28 to move together in accord in a longitudinal fashion (i.e., away from or toward handle base 90). However, upper stem base 26 and lower stem base 28 can rotate relative to each other based on the pivot point area 29 defined by rod 27. This rotation helps to neutralize the rotating force created by locking mechanism 30. In other words, to the extent that engaging or disengaging locking mechanism 30 would otherwise create rotational pressure on stem base 20, and thus on bristle holding tree 40 to which stem base 20 is engaged, pivot point 29 helps relieve the pressure by enabling upper stem base 26 and lower stem base 28 to rotate freely relative to each other. Advantages of the freely rotatable pivot point area 29 include reducing the stress on the assembly of the brush, reducing wear on bristles 60, and enabling use of an efficient locking mechanism.

Stem base 20 is enclosed by spring 25. Spring 25 surrounds stem base 20 so that it engages upper locking mechanism 32. Spring 25 creates a force pulling bristle holding tree 40 toward handle base 90 so as to retract bristles 60 toward housing 50. Accordingly, stem base 20 engages bristle holding tree 40 and locking mechanism 30.

Turning now to the upper portion of the brush, there are disposed bristle holding tree 40 and housing 50. Housing 50 encloses bristle holding tree 40. Bristle holding tree 40 is secured to upper stem base at joint 42. As indicated in FIGS. 3 and 4A, the securing may be done by fixing together bristle holding tree 40 to stem base 20 by for example a locking screw 44. Naturally, other means of securing are possible, such as gluing.

Also, bristle holding tree 40 and upper stem base 26 may be made of one unitary member.

As can be seen for example in FIG. 1, housing 50 contains apertures 62 through which bristles 60 extend. It can be seen that bristle holding tree 40 is disposed within the housing 50.

Figure 5:
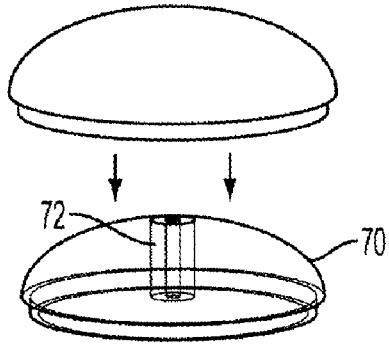
FIG. 5 shows a top mold of a brush in accordance with an embodiment.

As seen in FIG. 5, a top mold 70 may be disposed at the uppermost end of the brush. Top mold 70 caps the brush. It contains a cavity into which bristle holding tree 40 may be disposed.

Figure 6A:
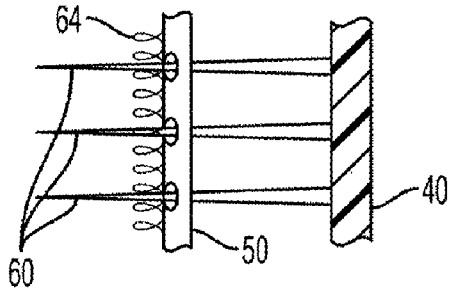
FIG. 6A shows an original position of an upper assembly of a brush in accordance with an embodiment.
Figure 6B:
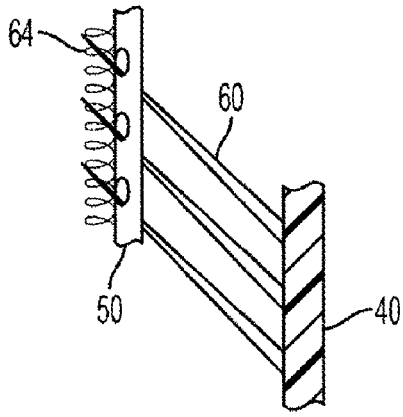
FIG. 6B shows a position of an upper assembly of a brush in accordance with an embodiment upon movement of an inner assembly.
Figure 6C:
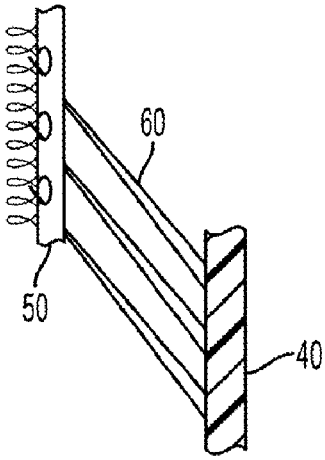
FIG. 6C shows a position of an upper assembly of a brush in accordance with an embodiment upon further movement of an inner assembly.
Figure 6D:
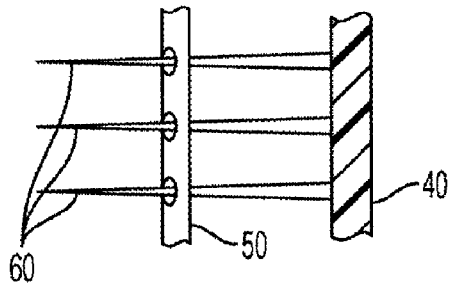
FIG. 6D shows a position of an upper assembly of a brush in accordance with an embodiment upon a return of the upper assembly to an original position.

Next, the operation of retracting the brush will be described, depicted in FIGS. 6A-6D. In the extended position depicted in FIG. 6A, bristles 60 are extended when spring 25 is in its uncompressed position. When the user depresses clicker 80, clicker 80 applies force on lower locking mechanism 34. This permits locking mechanism 30 to disengage its lock and allow upper locking mechanism 32 to slide down, guided by the grooves of lower locking mechanism 34. Spring 25, which is engaged with upper locking mechanism 32, forces down engaged stem base 20, which in turn forces down connected bristle holding tree 40. The longitudinal movement of bristle holding tree 40 relative to housing 50 moves bristles 60 from a generally perpendicular angle to a more acute angle relative to brush top 92. This is seen in FIG. 6B. When assembled, top mold 70 and housing 50 are secured with respect to each other. Accordingly, the bristle protrusion distance decreases such that hair 64 can more easily be slid off bristles 60. When the bristles are fully retracted, as in FIG. 6C, it will be relatively simple to remove the hair by sliding it off of the top portion of the brush (without additional devices or processes). After the hair 64 is removed, the clicker can once again be depressed. By depressing the clicker once more, the reverse of the operation given above occurs and the bristles 60 are returned to their extended position. This returns stem base 20, bristle holding tree 40 and bristles 60 to their original position. Now, after the assembly is returned to the original position, the bristles will be free of most if not all hair, as seen in FIG. 6D. Instead of upper locking mechanism 32 moving down, it rotates and locks back in place again. This represents the rotational force neutralized as a result of pivot point 29.

In an embodiment, by way of non-limiting example, handle 10 may be about 7-9 inches long. It may be 1-2 inches in diameter over the bottom 5-6 inches, while over the remaining 2-3 inches the diameter gradually increases until it may be anywhere from 2-5 inches in diameter depending on the size of the brush. Handle 10 may be made of plastic, again by way of non-limiting example.

It should be noted that whereas terms of relative orientation are used herein, they are meant to illustrate an invention and not limit said invention thereby.

Figure 7A:
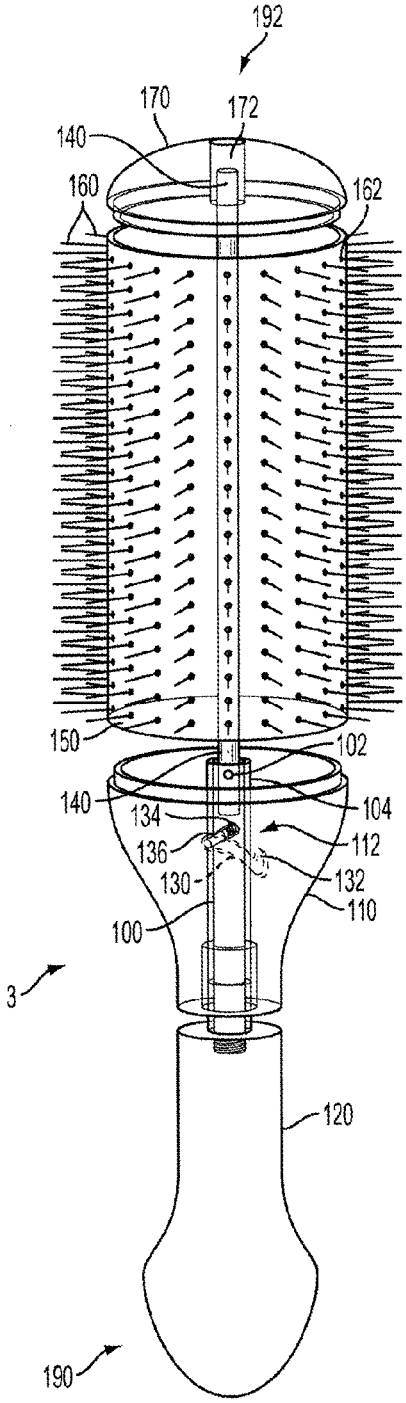
FIG. 7A shows an assembly disposed within a handle in accordance with an embodiment.
Figure 7B:
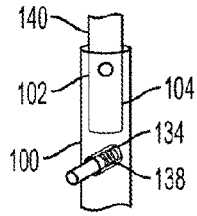
FIG. 7B shows detail relating to an upper portion of a connector.

In various embodiments, a brush 3 as in FIG. 7A employs rotational force to create bristle retraction by the user's turning a lower handle relative to an upper handle and introduces a locking feature to hold the bristles stationary, for easy cleaning.

As shown in FIG. 7A, the stem in various embodiments will receive the lower portion of bristle holding tree 140. However, the stem will now comprise connector 100 which receives bristle holding tree 140. Housing the lower portion of bristle holding tree 140 and connector 100 is upper handle 110. Upper handle 110 is engaged with lower handle 120 but able to move rotationally with respect to lower handle 120. Upper handle 110 has a cavity 112 therethrough to contain connector 100, as well as a downward slanting channel with an angled chamber at the end, the channel serving as guide path 130, which guides peg 136. The bottom of upper handle 110 may be of a width such that lower handle 120 can slide into it. Connector 100 comprises a joint 104 that joins the bottom of bristle holding tree 140 and top of connector 100. In one non-limiting method of securing this portion, adhesive may be applied, and a screw 102 tightened. The middle portion of connector 100 includes peg cavity 134 on the lateral portion of connector 100. Spring 138 is disposed within peg cavity 134 as well as peg 136. Peg 136, which may be a rigid material such as metal, may be slightly smaller in diameter than peg cavity 134, and is forced outwards by spring 138. In this manner, peg 136 may be disposed within peg cavity 134 but extends into guide path 130 in the final assembly. Peg 136 may also be secured to connector 100 by a screw (not shown), or connector 100 may be a one-piece unitary assembly including peg 136. The bottom portion of connector 100 may be threaded (not shown) so that it may be screwed into lower handle 120. Connector 100 is secured to lower handle 120.

It will also be recognized that connector 100 and bristle holding tree 140 may be a single unitary member.

Figure 7C:
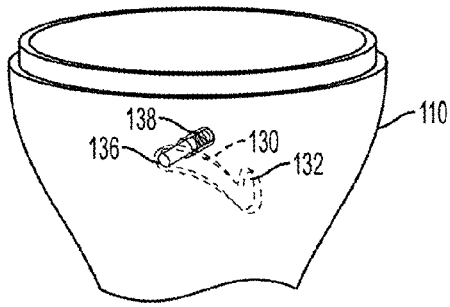
FIG. 7C shows detail relating to a guide path terminating in an angled locking chamber.

Peg 136, guide path 130 and angled locking chamber 132 are seen in greater detail in FIG. 7C. Angled locking chamber 132 is offset at an angle to the remainder of guide path 130. As described below, when peg 136 rides down guide path 130 into angled locking chamber 132, peg 136 is forced upwards in the direction of brush top 192 due to the upward vector generated by bristles 160 when they are bent.

Figure 8A:
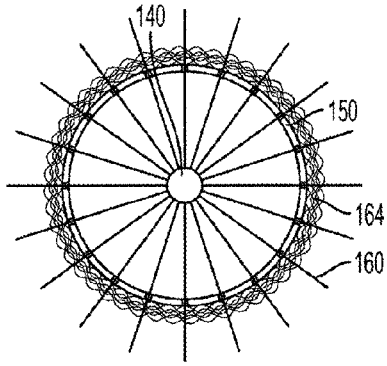
FIG. 8A shows an original position of an upper assembly of a brush in accordance with an embodiment.

Now the retraction of bristles 160 inside housing 150 will be discussed. FIG. 8A is a cross-sectional view showing housing 150, bristles 160 and hair 164. Bristles 160 protrude from housing 150. If the user rotates lower handle 120 relative to upper handle 110, peg 136, which may be disposed in guide path 130, helps the user turn the brush in the proper way, i.e., a downward sloping fashion. Guide path 130 may be sloped in order to enable the assembly to lock. At the end of guide path 130 is angled locking chamber 132. Because guide path 130 guides peg 136 (and in turn bristle holding tree 140) on a downward slope, this creates a countervailing upward resistive pull from bristles 160 in their apertures 162. Once peg 136 enters angled locking chamber 132, this upward resistive pull locks bristle holding tree 140 and peg 136 into place (in angled locking chamber 132), which holds bristles 160 stationary in a retracted position so that the user may remove hair 164.

Figure 7D:
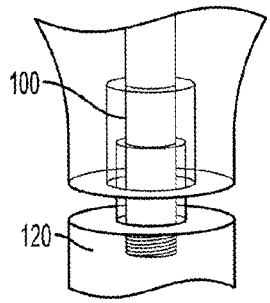
FIG. 7D shows detail relating to a bottom portion of a connector.

As shown in FIG. 7D, as one way to affix connector 100, the bottom portion of connector 100 may be threaded (not shown) so that it may be screwed into lower handle mold 120. Lower handle mold 120 needs to be separate from upper handle mold 110 to allow the user to hold the brush comfortably during rotation. The penetration of lower handle mold 120 into upper handle mold may be of a length allowing this to happen, such as approximately 1½" to increase the sturdiness and rigidity of the apparatus. Peg 136 in guide path 130 helps to keep lower handle mold 120 and upper handle mold 110 from separating. Unwanted movement of connector 100 is minimized by both the upward force of bristles 160 but also peg 136 in guide path 130. These features likewise minimize the chance that unwanted force would separate lower handle mold 120 from upper handle mold 110.

Optionally, a lip or other structure may be formed on one or both of lower handle mold 120 and upper handle mold 110 so that upon rotation there is an additional structure that prevents lower handle mold 120 and upper handle mold 110 from separating.

As shown in FIG. 7A, top mold 170 is affixed to the top of the brush and has a cavity 172 into which the top of bristle holding tree 140 is inserted such that bristle holding tree 140 remains generally centered and bristles 160 generally in their proper apertures 162.

Figure 8B:
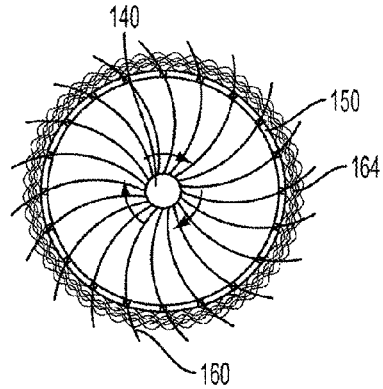
FIG. 8B shows a position of an upper assembly of a brush in accordance with an embodiment upon movement of an inner assembly.

In the original position, as shown in FIG. 8A, bristles 160 extend from housing 150. Lower handle 120 may be turned relative to upper handle 110. Peg 136, which may be disposed in guide path 130, helps guide the user to turn the brush in the proper way. This results in bristles 160 beginning to retract into housing 150, as shown in FIG. 8B. At the end of guide path 130 is angled locking chamber 132. Because guide path 130 forces peg 136, and in turn bristle holding tree 140, on a downward slope, this creates an upward pull from bristles 160 in apertures 162.

Figure 8C:
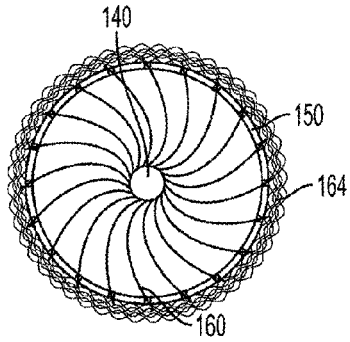
FIG. 8C shows a position of an upper assembly of a brush in accordance with an embodiment upon further movement of an inner assembly.

Once peg 136 rides into angled locking chamber 132, this upward pull locks bristle holding tree 140 and peg 136 in place so that, as shown in FIG. 8C, the assembly is in a locked position such that the user is free to remove hair 164 off of housing 150.

The forces herein are now discussed. The first force in various embodiments—with the reference being that the brush is held with base 190 pointing down—can be considered horizontal, i.e., a rotational force originating from lower handle 120 being turned relative to upper handle 110. One result of this force—as transferred through connector 100 which is connected to bristle holding tree 140—is to impel that portion of bristles 160 proximal to bristle holding tree 140 to move in the direction of this rotational force. However, a portion of bristles 160 closer to their tips, whose movement is constrained by apertures 162 on housing 150, is held back. Because bristles 160 have some degree of flexibility, this causes bristles 160 to assume a more acute angle relative to bristle holding tree 140 and thus retract toward apertures 162.

The second force in various embodiments is vertical, generated by peg 136 being caused to move in downward-sloping guide path 130. This in turn creates a downward pressure on engaged connector 100 and bristle holding tree 140. The downward slope thus transfers a downward force to the portion of bristles 160 proximal to bristle holding tree 140 in the direction of handle base 190. And, because the tips of the generally flexible bristles 160 are constrained by apertures 162, this downward force causes the bristles effectively to retract towards housing 150. However, in contacting and being constrained by housing 150 in this fashion, the bristles now assume a bent state as they retract. A force is generated in bristles 160 by which they want to return to their natural, unbent state. This force creates an upward pull toward brush top 192. Once peg 136 rides into angled locking chamber 132 at the end of guide path 130, this upward force—caused by the bristles wanting to return to their unbent state—serves to lock the assembly. Angled locking chamber 132 also prevents the bristles from moving in a rotational direction as well. Thus the assembly is locked.

Accordingly, the two forces in various embodiments—generated by rotating lower handle 120 relative to upper handle 110, in combination with peg 136 riding in downward-sloping guide path 130 and terminating in angled locking chamber 132—interact to create the retraction of bristles 160 towards and inside of housing 150, and also to lock bristles 160 in place for easy cleaning accomplished with minimum need to control the brush assembly.

Figure 8D:
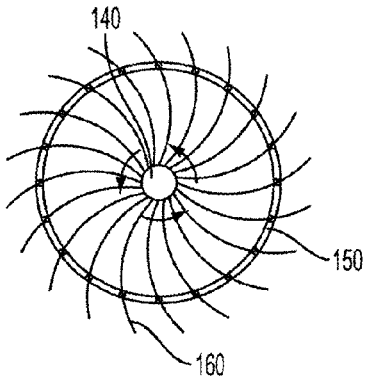
FIG. 8D shows a position of an upper assembly of a brush in accordance with an embodiment upon movement of an inner assembly as the inner assembly is returning to an original position.
Figure 8E:
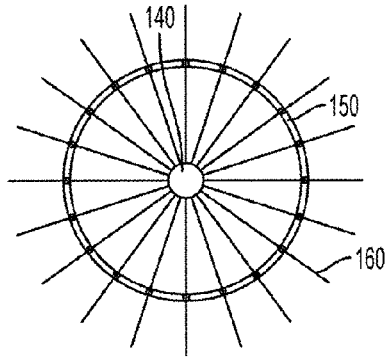
FIG. 8E shows a position of an upper assembly of a brush in accordance with an embodiment upon movement of an inner assembly after the inner assembly has returned to an original position.

Once the hair is removed, the user can rotate upper handle 110 and lower handle 120 in a fashion opposite to that used to retract bristles 160, such that bristles 160 return toward their original position, as shown in FIG. 8D. Eventually, bristles 160 return to their originally extended position as shown in FIG. 8E, with the important benefit that hair has been removed.

Figure 9A:
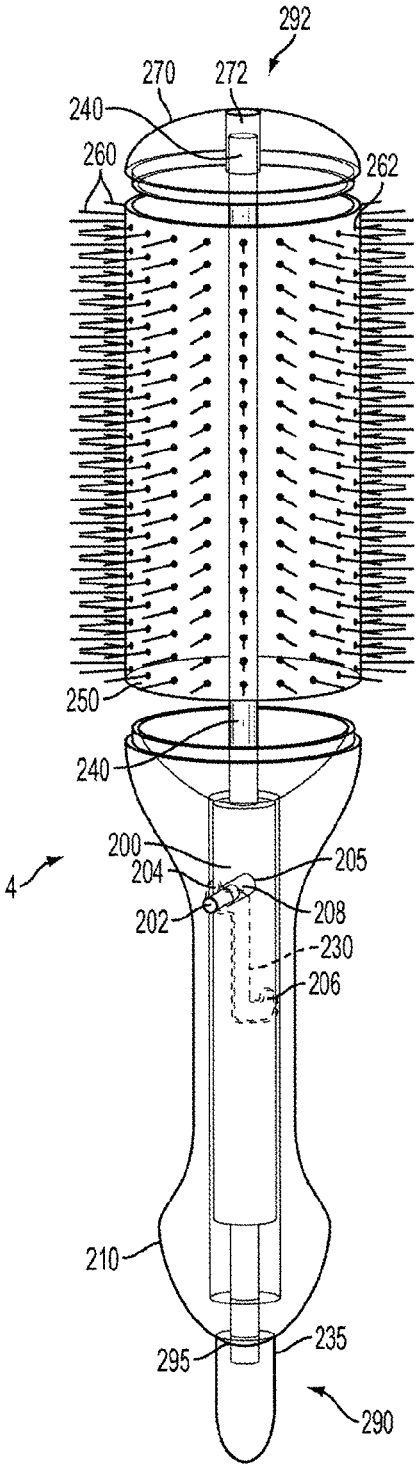
FIG. 9A shows a brush having a handle assembly in accord with an embodiment in a first position.
Figure 9B:
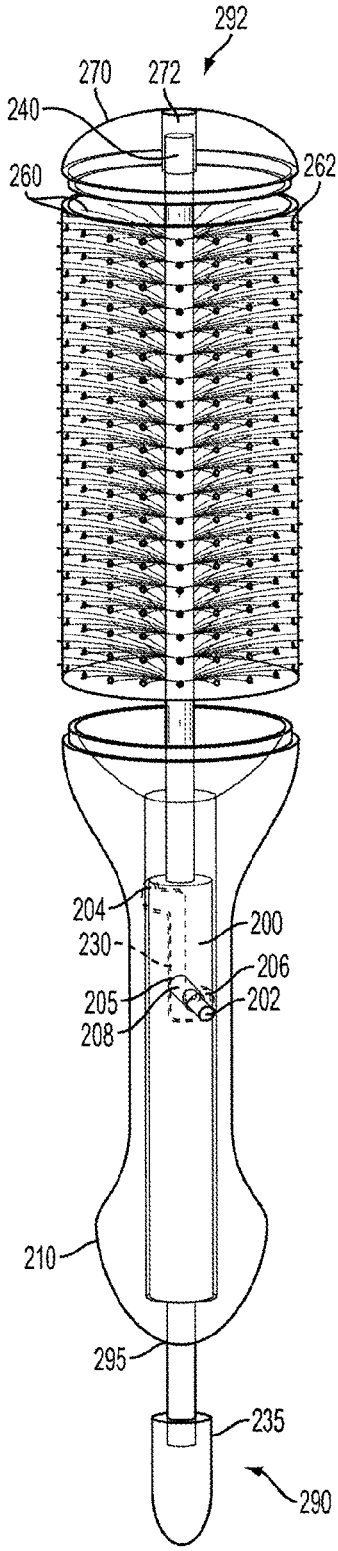
FIG. 9B shows a brush having a handle assembly in accord with an embodiment in a second position.

In various embodiments, a brush 4, as depicted in FIGS. 9A and 9B, employs arm 235 to apply force to connector 200, wherein said force is thereupon transferred via engaged bristle holding tree 240 to bristles 260, causing bristles 260 to retract relative to housing 250.

As shown in FIG. 9A, arm 235 is secured to connector 200 by a screw (not shown) or other method, or may be a one-piece unitary assembly. Connector 200 is secured to bristle holding tree 240. Peg 202 is disposed in peg cavity 205 of connector 200. Peg 202 rides on spring 208. Peg 202 may also be secured by a screw (not shown) or other method, or connector 200 may be a one-piece unitary assembly with peg 202 fabricated to extend from connector 200. Peg 202 is disposed within a channel in handle 210 that serves as a guide path 230, and may ride along guide path 230 when the user applies force. Guide path 230 terminates in two chambers 204, 206 on each end. Chamber 204, in which peg 202 rests in the original position in which bristles 260 extend in largely perpendicular fashion out of housing 250, is to one side of guide path 230.

As shown in FIG. 9A, top mold 270 is affixed to the top of the brush and has a cavity 272 into which the top of bristle holding tree 240 is inserted such that bristle holding tree 240 remains generally centered and bristles 260 generally in their proper apertures 262.

As shown in FIGS. 9A and 9B, connector 200 is disposed in handle 210. When a user wishes to retract bristles 260, the user grasps arm 235. The user rotates arm 235 slightly to disengage peg 202 from chamber 204. Now peg 202 is engaged with the main portion of guide path 230. The user pulls down arm 235 toward base 290. This force guides peg 202 down along guide path 230. Because arm 235 is engaged with connector 200, which in turn is engaged with bristle holding tree 240, which itself is engaged with bristles 260, the user can cause that portion of bristles 260 proximal to housing 250 to move down in the same direction as bristle holding tree 240. This causes bristles 260 to retract as seen in FIG. 9B. Once peg 202 is pulled down to the lowest portion of guide path 230, the user will use arm 235 to rotate peg 202 toward the side to engage with chamber 206. Because bristles 260 are now retracted and contain a force wherein bristles 260 wish to return to their original largely perpendicular position, once peg 202 is disposed within chamber 206 the upward force of bristles 260 causes peg 202 to lock in place, causing the assembly to be stationary, allowing for efficient removal of hair. Once hair is removed, the user undertakes the opposite sequence of actions whereby arm 235 is pushed back toward top of brush 292, causing peg 202 to disengage from chamber 206, up guide path 230, and back into chamber 204.

It will also be recognized that connector 200 and bristle holding tree 240 may be a single unitary member.

Chambers 132, 204 and 206 of various embodiments may be shaped in such a way that locking is accomplished efficiently, and wherein the exact configuration of such terminal portion of the guide paths 130, 230 respectively described therein can be considered bumps or end stops.

The bottom of handle mold 210 may narrow to prevent the user from pulling out connector 200, which may be fashioned wider than opening 295.

In the foregoing a brush has been described wherein the material removed therefrom has been hair. It will be understood that the material to be removed can also be animal hair or fur. Also, it will be understood that there may be other environments where the material removed therefrom could be an unwanted deposit or detritus. In other words, it may be possible that various embodiments described herein can apply to a brush apparatus for use in cleaning industrial pipe or other environment.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, it is to be understood that these disclosures are only illustrative and exemplary and are made merely for purposes of providing a full and enabling disclosure. The foregoing is not intended or to be construed to limit the present invention or otherwise to exclude any such other embodiments, adaptations, variations, modifications and equivalent arrangements. The invention has been described with reference to various specific embodiments and techniques. However, it will be apparent to one of ordinary skill in the art that many variations and modifications may be made while remaining within the spirit and scope of the invention.

I claim:

1. A brush, comprising:

a bristle-holding tree having bristles;

a housing disposed around the bristle-holding tree, the housing having at least one aperture through which at least one of the bristles extends;

a stem base engaged with the bristle-holding tree; and a locking mechanism engaged with the stem base, wherein the locking mechanism includes an upper locking mechanism comprising at least one first groove and a lower locking mechanism comprising at least one second groove, wherein the at least one first groove engages with the at least one second groove when a member engaged with the lower locking mechanism is depressed, and wherein the locking mechanism is structured to move the bristle-holding tree and the stem base as a unit longitudinally relative to the housing between an extended position and a retracted position, wherein:

(a) in the extended position, the bristles extend to a protrusion distance relative to the bristle-holding tree through the apertures of the housing, and (b) in the retracted position, the bristles retract to a retraction distance relative to the bristle-holding tree, wherein the bristle protrusion distance is greater than the bristle retraction distance.

2. The brush of claim 1, wherein the stem base comprises an upper stem base and a lower stem base joined at a pivot point, wherein the upper stem base and the lower stem base are rotatable relative to each other at the pivot point.

3. The brush of claim 1, wherein the bristle-holding tree and at least a portion of the stem base together comprise a unitary structure.

4. A brush, comprising:

a bristle-holding tree having bristles;

a housing disposed around the bristle holding tree, the housing having at least one aperture through which at least one of the bristles extends; and a connector engaged with the bristle-holding tree and disposed within an upper handle and a lower handle, wherein the upper handle comprises a sloping guide path through which a peg is slidably disposed, wherein movement of the lower handle relative to the upper handle imparts rotational and longitudinal force to the bristle-holding tree through the connector to cause the bristles to move between an extended position and a retracted position, wherein:

(a) in the extended position, the bristles extend to a protrusion distance relative to the bristle-holding tree through the apertures of the housing, and (b) in the retracted position, the bristles retract to a retraction distance relative to the bristle-holding tree, wherein the bristle protrusion distance is greater than the bristle retraction distance.

5. The brush of claim 4, wherein the guide path terminates in an angled locking chamber.

6. The brush of claim 5, wherein the peg is positioned in the angled locking chamber to lock the bristle-holding tree in the retracted position.

7. The brush of claim 5, wherein a combination of rotational force caused by rotating said upper handle and lower handle relative to each other, and longitudinal force caused by resistant force of said bristles against said housing upon said bristles, causes said bristles to retract and lock.

8. The brush of claim 4, wherein the upper handle includes a lip structured to resist separation of the upper handle and the lower handle.

9. The brush of claim 4, wherein the bristle-holding tree and connector together comprise a unitary structure.

10. A brush, comprising:

a bristle-holding tree having bristles;

a housing disposed around the bristle-holding tree, the housing having at least one aperture through which at least one of the bristles extends;

a connector engaged with the bristle-holding tree; and an arm extending from the connector wherein application of force to the arm causes the connector and bristle-holding tree to move longitudinally as a unit relative to the housing between an extended position and a retracted position, wherein:

(a) in the extended position, the bristles extend to a protrusion distance relative to the bristle-holding tree through the apertures of the housing, and (b) in the retracted position, the bristles retract to a retraction distance relative to the bristle-holding tree, wherein the bristle protrusion distance is greater than the bristle retraction distance.

11. The brush of claim 10, wherein at least a portion of the connector extends through a handle of the brush, and further comprising a guide path formed in the handle.

12. The brush of claim 11, further comprising a peg projecting from the connector, wherein the peg is slidably disposed within the guide path.

13. The brush of claim 11, wherein the guide path terminates at a first end in a first locking chamber in which the peg is disposed in the extended position.

14. The brush of claim 11, wherein the guide path terminates at a second end in a second locking chamber in which the peg is disposed in the retracted position.

15. The brush of claim 10, wherein the bristle-holding tree and connector together comprise a unitary structure.

* * * * *